US006003463A

United States Patent [19]

Giesler

[11] Patent Number: 6,003,463

[45] Date of Patent: Dec. 21, 1999

[54] DUAL POSITION PERSONAL WATERCRAFT LIFT

[75] Inventor: Gary D. Giesler, Wellesley, Canada

[73] Assignee: DWF Products Ltd., Ontario, Canada

[21] Appl. No.: 09/069,686

[22] Filed: Apr. 29, 1998

Related U.S. Application Data

[60] Provisional application No. 60/071,704, Jan. 16, 1998.

[30] Foreign Application Priority Data

Aug. 21, 1997 [CA] Canada ..... 2213603

[51] Int. Cl.[6] ..... B63B 35/40

[52] U.S. Cl. ..... 114/259; 114/336; 414/137.7

[58] Field of Search ..... 114/259, 365, 114/366, 368, 369, 44; 405/3; 414/137.7, 541

[56] References Cited

U.S. PATENT DOCUMENTS

| | | | |
|---|---|---|---|
| 2,761,571 | 9/1956 | Adams . | |
| 3,536,023 | 10/1970 | Toher et al. . | |
| 3,993,011 | 11/1976 | Garland . | |
| 4,493,603 | 1/1985 | Williams et al. | 414/541 |
| 4,763,592 | 8/1988 | Russ | 114/45 |
| 4,797,055 | 1/1989 | Tworoger et al. . | |
| 4,976,211 | 12/1990 | Reinhardt . | |
| 5,052,879 | 10/1991 | Wolfe | 414/541 |
| 5,544,606 | 8/1996 | Schmidt, Jr. . | |
| 5,593,247 | 1/1997 | Endres et al. . | |
| 5,628,583 | 5/1997 | Gibson . | |

FOREIGN PATENT DOCUMENTS 628507 8/1949 United Kingdom .

*Primary Examiner*—Sherman Basinger
*Attorney, Agent, or Firm*—Alston & Bird LLP

[57] ABSTRACT

A launch and retrieval system for a smaller watercraft comprising a cradle for a smaller watercraft, a first vertically oriented drive, a device for securing the cradle to the first drive for vertical movement for launch and retrieval of the watercraft, a second horizontally oriented drive for preferably aft mounting on a larger watercraft. The second drive has a low profile telescoping frame having a first part fixed to the aft mounting device and a telescopic second part. The drive has power device to reciprocate the second part relative to the first. A device is provided for mounting the first drive to the outboard end of the telescopic second part to position thereby the mounting of the first drive to the second drive at about swing platform level. The first drive elevates the cradle to a level for its storage position which permits second drive to retract at least a portion of the cradle to within the second drive.

21 Claims, 10 Drawing Sheets

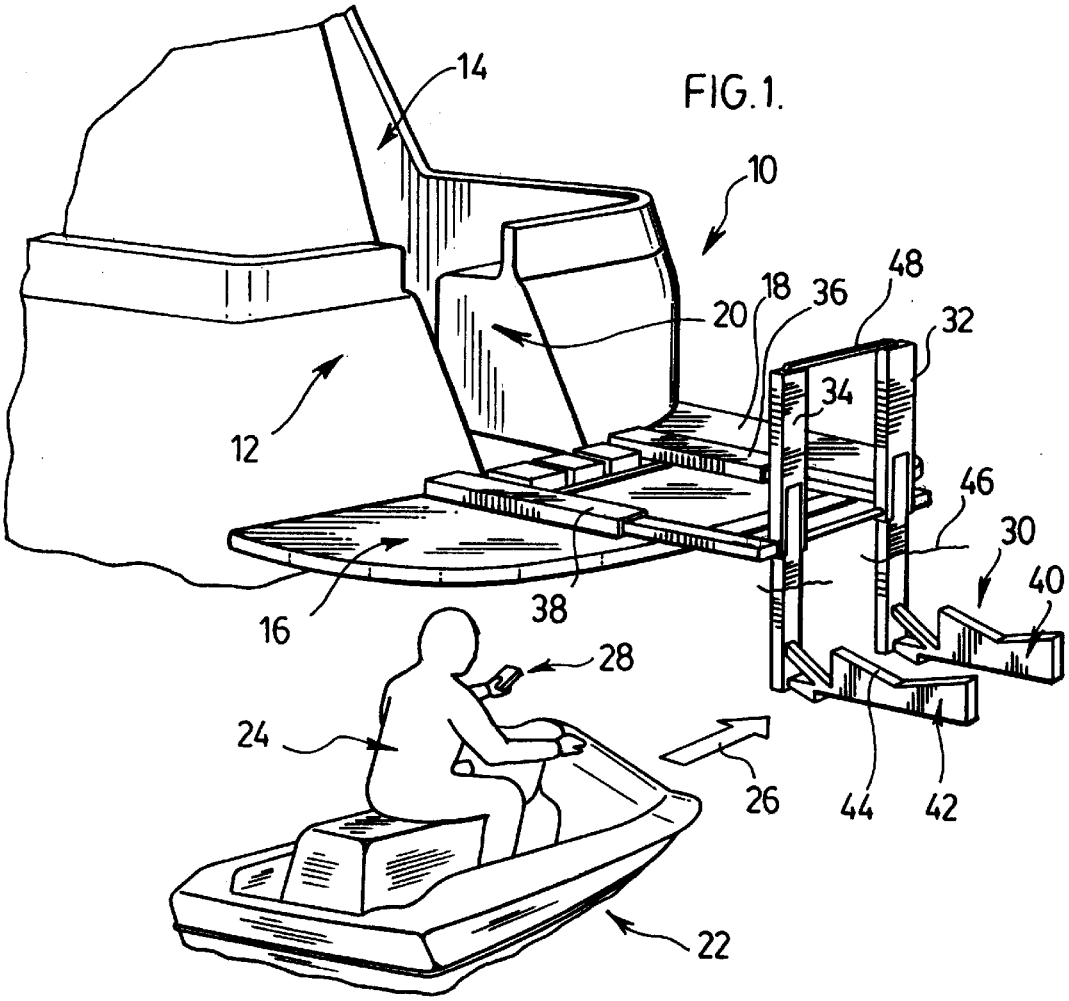
FIG. 1.
FIG. 2.
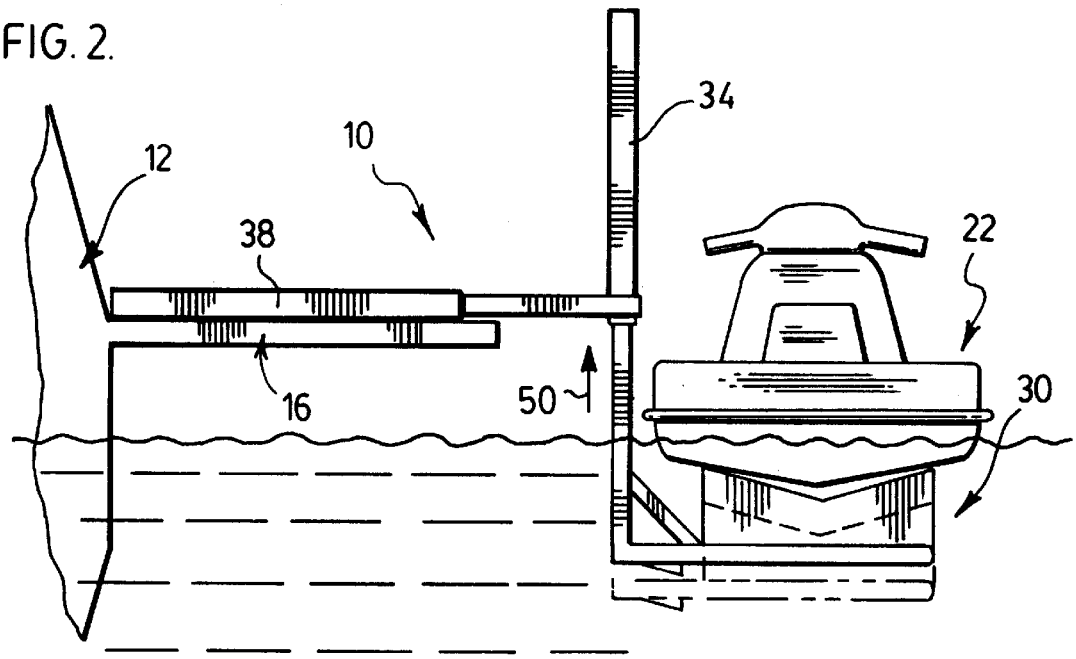

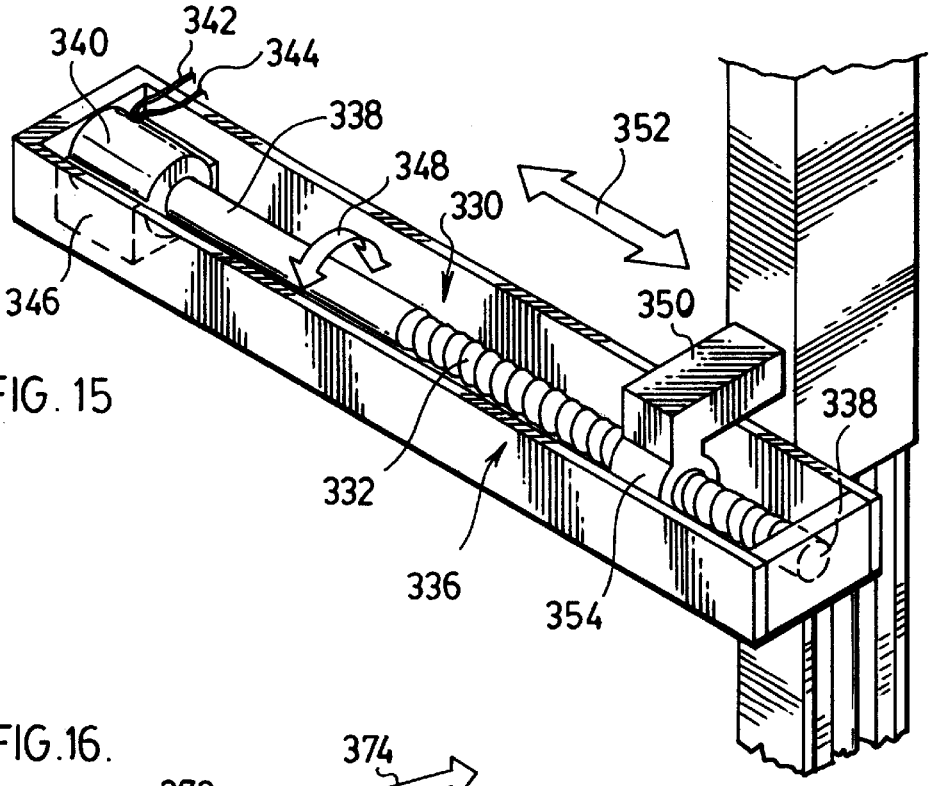
FIG. 15
FIG. 16.
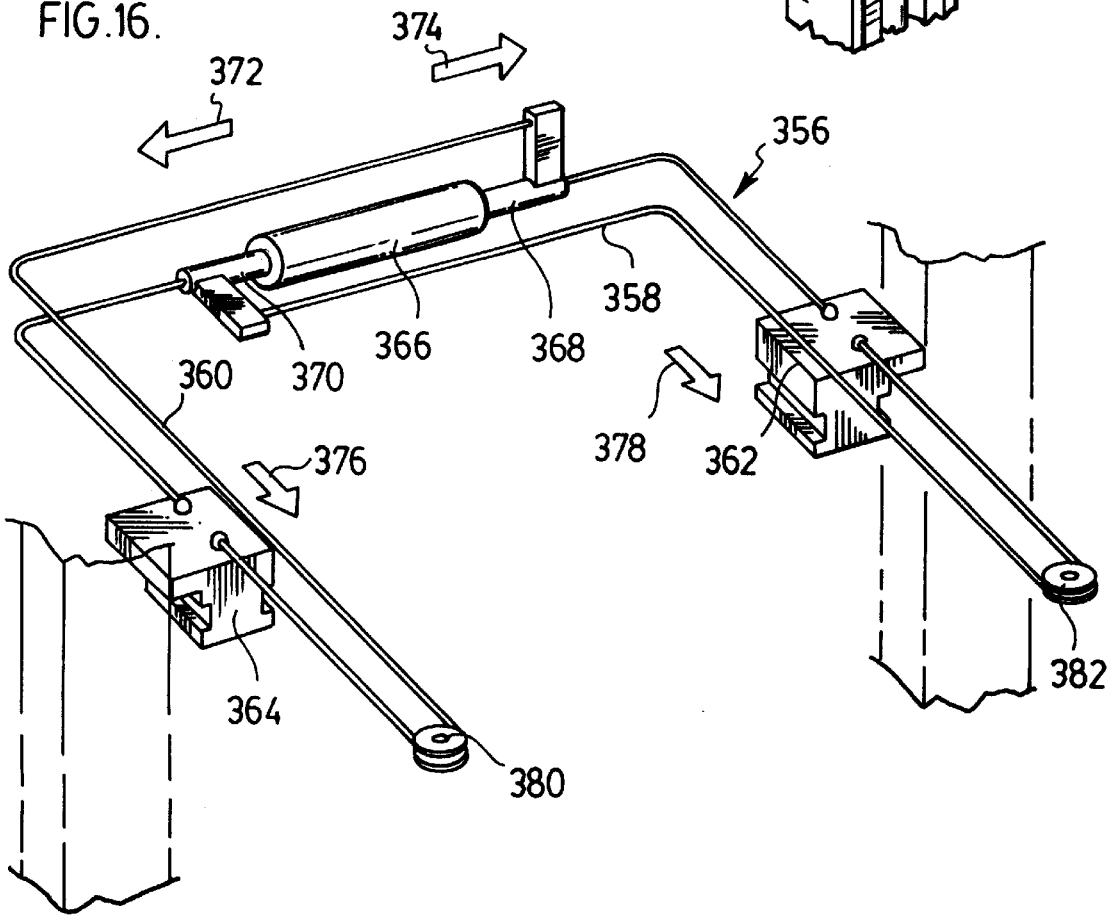

DUAL POSITION PERSONAL WATERCRAFT LIFT

This application claims the benefit of U.S. Provisional Appln. No. 60/071,704 filed Jan. 16, 1998.

FIELD OF THE INVENTION

This invention relates to a launch and retrieval system for smaller watercraft and the like, particularly when the system is used on large watercraft.

BACKGROUND OF THE INVENTION

With larger watercraft, there is a desire to carry on board smaller craft to provide an alternate form of water transportation; for example, navigation about yacht clubs, exploring beaches, and transport to and from a large yacht anchored offshore. Various devices are available to mount the smaller watercraft on the larger craft; for example winches may be used to haul the craft from the water surface onto the side of the larger craft. Attempts have also been made at storing personal watercraft at the aft of the yacht. This may include, for example, tying or strapping a personal watercraft to the swim platform. The problem with the existing devices is that they are difficult to use, unsightly on the aft of the craft, are expensive to install, are not secure in strapping the watercraft to the yacht so that loss of watercraft may result and can be hazardous when people are transferring from the smaller watercraft to the retrieval system on the larger watercraft.

As can be appreciated, on ships and the like, marine hoists have been provided such as described in U.S. Pat. No. 2,761,571. This marine hoist is very complex, bulky and unacceptable for use on smaller craft. Furthermore, the marine hoist is pivoted about a point above the deck level of the ship which requires reinforcing guide wires or the like to prevent tipping of the hoist during launch and retrieval of a smaller craft.

U.S. Pat. No. 5,544,606 describes a launch and retrieval system for smaller craft which may be mounted to the transom of a boat or to a dock. The system requires the removal of any swim platform from the rear of the boat and also requires bringing the personal watercraft very close to the aft of the boat which can result in collision with the boat aft during the retrieval process. This can result in potential damage of either craft in rough waters.

It is an object in accordance with an aspect of the invention to provide a launch and retrieval system which overcomes the problems associated with the above-noted prior art devices and provides a launch and retrieval system which meets other objectives including easy-to-manufacture and install, foolproof to operate and safe to use.

SUMMARY OF THE INVENTION

In accordance with an aspect of the invention, a launch and retrieval system for a watercraft is adapted for mounting at the aft of a large watercraft. The system comprises:

i) a cradle for a watercraft;

ii) a first vertically oriented drive;

iii) means for securing the cradle to the first drive for vertical movement from a watercraft launch or retrieval lower position to an upper storage position;

iv) a second horizontally oriented drive and aft mounting means for aft mounting the second drive at about swim platform level of a larger watercraft, the second drive having a low profile telescoping frame having a first part fixed to the aft mounting means and a telescopic second part, the second drive having power means to reciprocate the second part relative to the first part, the telescopic second part having an outboard end;

v) means for mounting the first drive to the outboard end of the telescopic second part of the second drive to position thereby the mounting of the first drive to the second drive at about swim platform level, the second drive moving the vertically oriented first drive from an extended cradle storage position to retracted cradle storage position; and vi) the first drive elevating the cradle to a level for its storage position which permits the power means to retract at least a portion of the cradle to within the second drive.

BRIEF DESCRIPTION OF THE DRAWINGS

Preferred embodiments of the invention are shown in the drawing wherein:

FIG. 1 is a perspective view of an aft portion to which a preferred embodiment of the launch and retrieval system is mounted;

FIG. 2 is a side elevation of the system retrieving a personal watercraft;

FIG. 15 is a perspective view of alternative embodiment of a device for extending and retracting the first drive; and FIG. 16 is a perspective view of yet another alternative embodiment of the device for extending and retracting the horizontal drive.

DETAILED DESCRIPTION OF THE PREFERRED EMBODIMENTS

Figure 3:
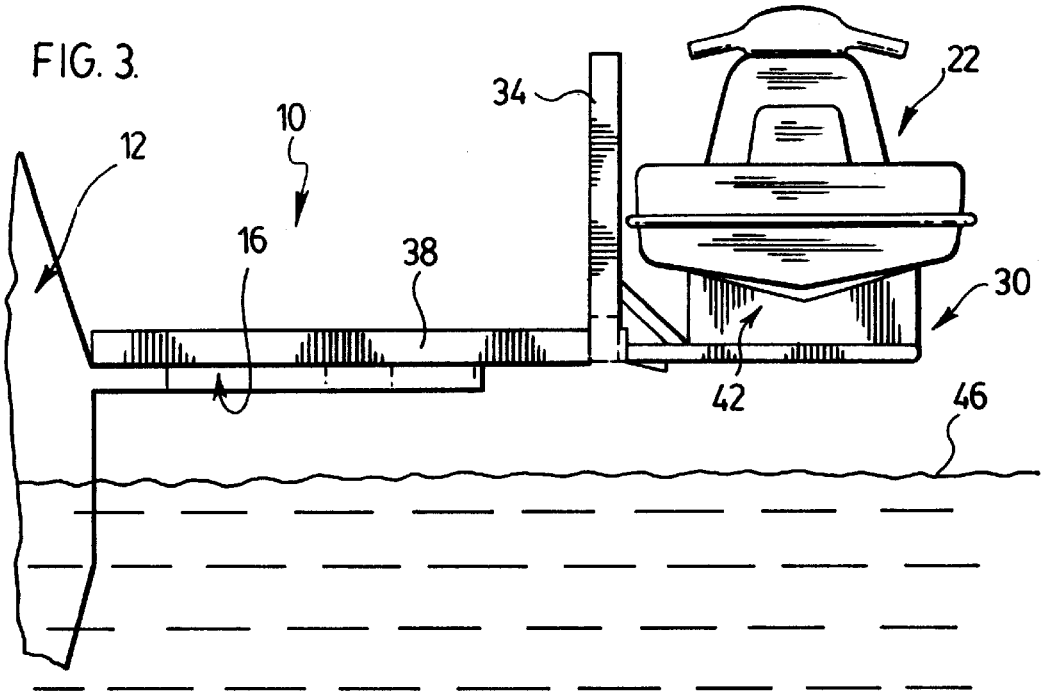
FIG. 3 is a side elevation of the system in the elevated retrieval position.

With reference to the drawings, an aspect of a launch and retrieval system of this invention will be described for launching and retrieving personal watercraft which are considerably smaller than the much larger watercraft on which the system is mounted. Such smaller watercraft may usually be of the personal jet boat design and commonly sold under the trade-mark SEADOO by Bombardier Inc. It is understood, of course, that the system of this invention may be used for launching and retrieving a variety of other types of small craft, such as dinghies, sailboats, outboard motor-powered boats, speed boats and the like. Although the description of the drawings relates to structure for launch and retrieval of personal watercraft, it is understood that the structure may be enlarged, or for that matter even mounted differently on the aft of the craft, to provide for launch and retrieval of heavier watercraft, such as outboard or inboard powered speedboats, such as might accompany a yacht of 15 meters and up in length. The system, however, is still adapted for mounting on the aft of the vessel, so that launch and retrieval with people in or on the smaller craft is achieved close to water level which is normally approximated by the position of the swim platform on the yacht or sailboat. This ensures safety in transfer of people to and from the craft, particularly in rough waters. By virtue of the low profile for the system, freedom movement about a swim platform or level platform is permitted. The system is low and hence does not move about over the heads of the passengers as is the case with overhead cranes.

With reference to FIG. 1, a launch and retrieval system generally designated 10 is mounted to an aft portion 12 of a large craft 14. In accordance with this particular embodiment, the craft 14 is provided with a swim platform 16 and the system 10 is mounted on a surface 18 of the swim platform. It is understood, of course, that in the absence of a swim platform, custom mounting of the system 10 to the aft 12 can still be achieved by building with suitable brackets a mounting system which presumably functions in a manner similar to the swim platform. Most medium-sized and smaller sized craft 14 now include a walkway generally designated 20 which allows people access to the aft of the craft 14. Larger yachts may have a ladder extending down to the swim platform. The platform 16, whether it be a swim platform or a constructed unit, allows people to easily access the personal watercraft 22 carried on the system 10. As demonstrated in FIG. 1, an operator 24 is driving a personal watercraft 22 in the direction of arrow 26 towards the system 10. In accordance with this particular embodiment, the operator 24 has a hand-held transmitter 28 which controls the operation of the system 10 in the launch and retrieval process. The system 10 has a cradle 30 mounted to spaced apart vertical drives 32 and 34. The vertical drives 32 and 34 are, in turn, secured to horizontal drives 36 and 38. The cradle 30 includes separate cradle arms 40 and 42. Each arm 40 and 42 includes a shaped chock portion 44 which is adapted to mate with the underside of the personal watercraft 22 in the area that it is supporting. It is appreciated that, depending upon the type of craft that is launched and retrieved by the system 10, the portions 44 may take on other shapes to suit the peculiarities of the personal watercraft or dinghy bottom. By virtue of the hand held transmitter 28, the cradle 30 can be positioned beneath the water level indicated by line 46 to allow the operator 24 to maneuver the watercraft 22 on top of the support arms 40 and 42. Alternatively, the operator 24 may maneuver the personal watercraft 22 generally over top of the cradle arms 40 and 42 and then by hand held transmitter 28 slowly raise the cradle 30 so as to commence lifting of the personal watercraft 22 and, in turn, allow the craft 22 to settle into the curved portion 44 of each cradle arm 40 and 42. In this respect, the operator 24 may hold onto the handrail 48 between the vertical drives 32 and 34 while slightly elevating the cradle 30 to commence lifting of the personal watercraft 22.

As shown in FIG. 2, the operator may either remain in the personal watercraft 22 or via the swim platform 16 move to within the boat. In either event, the operator actuates the system 10 to elevate the cradle 30 in the direction of arrow 50 towards its elevated retrieval position which is shown in FIG. 3. During the operation of the system in FIG. 2, the horizontal drives 36 and 38 remain stationary, as will be described in more detail with respect to the remaining figures, to provide for foolproof operation control. In water, it is also understood that the operator may choose to remain in the craft 22 to provide the necessary balance, to hold the personal watercraft 22 on the cradle 30 until it is clear of the water.

It is understood that, in the retrieval position of FIGS. 1 and 2, operator care must be exercised in compensating for wave height. In accordance with this invention by virtue of the aft mounting of the device and for larger yachts, retrieval of the craft can be accomplished in significant wave heights; for example, up to 0.5 to 0.7 meters. The retrieval is accomplished by pointing the larger craft into the waves to provide in the wake at the rear of the craft relatively calm waters to facilitate retrieval. In this situation, ideally, the operator remains in the personal watercraft 22 and by holding on to the handrail 48, ensures that the personal craft 22 stays in position so as to be picked up by the cradle 30 as the cradle 30 is elevated in the direction of arrow 50.

With reference to FIG. 3, the cradle 30 is elevated above the water level 46 to the upper storage position where the personal watercraft 22 is clear of the water level 46 and is approximately at the level of the swim platform 16. At this level, if the operator is in the personal watercraft 22, he can readily step out onto the swim platform 16. At this elevation, the larger craft 14 could be powered forwardly and rearwardly at slower speeds. However at higher speeds, the weight of the personal watercraft 22 may exert excessive strain on the system 10, particularly the horizontal drives 36 and 38 and the cradle mounting arms 40 and 42. Furthermore, it is a feature of this invention to provide for retraction of the cradle 30 from the elevated retrieval position or fully extended upper position of FIG. 3 to the retracted upper position of FIG. 4. The second drives 36 and 38 provide for retraction of the vertical drives 32 and 34 to an extent which preferably positions the personal watercraft 22 over at least a portion of the swim platform or system support 16. With the personal watercraft positioned close to the aft 12 of the larger craft, upon startup of the larger craft, the personal or smaller watercraft 22 is not dropped into the water because of the low level wake generated immediately behind the craft. In any event, it is preferable to have tie-down straps 54 secure the personal watercraft 22 in position. The tie-down straps 54 are connected to eyes 56 and 58 located on the individual cradle arms 40 and 42. It is also appreciated that the smaller watercraft has a length which is about the same or less than the beam of the larger craft and preferably less than the width of the aft of the larger craft. A further consideration in the design of the system is the height of the chocks 44 for the cradle arms 40 and 42. The chocks have a V-shaped design to mate with and support craft underside. The height of the chocks elevates the small craft above the platform to an extent that backwash when the larger craft slows down does not run into or forcibly against the cradelled small craft and knock it off the cradle. However, the small craft remains sufficiently low to minimize rocking forces on the larger craft as it sways in rough water. The tie downs 54 also resist any backwash knocking the small craft off its chocks. An additional benefit of the tie downs is that they may be designed to resist or prevent theft of the small craft. This feature adds greatly to the overall benefits of the system and may result in a reduction of boat insurance premiums by thwarting small craft theft.

Figure 4:
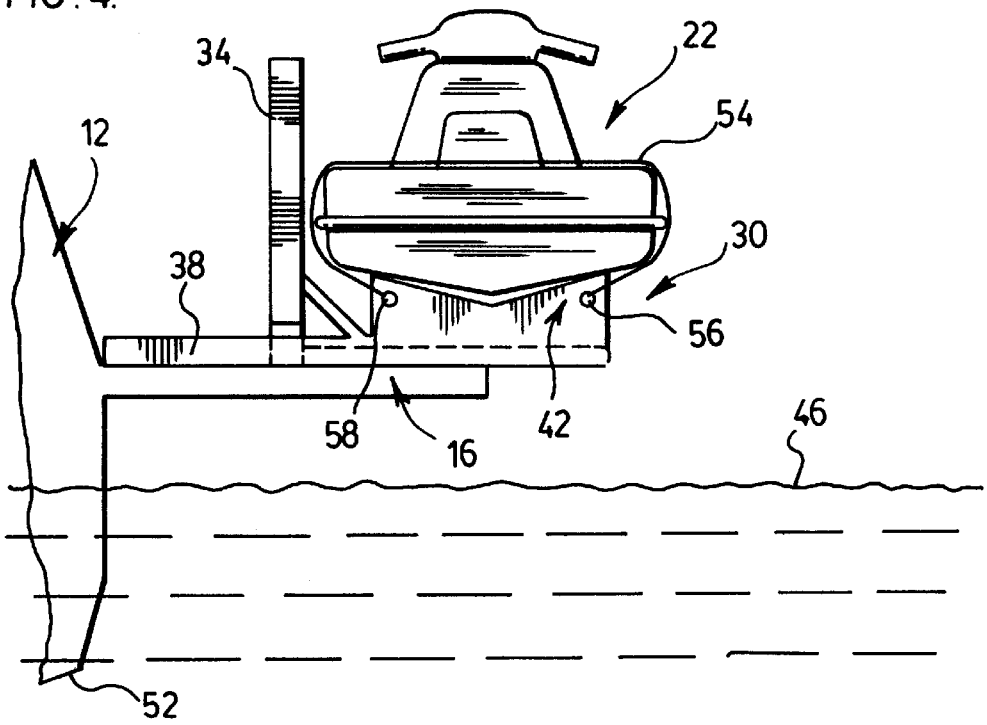
FIG. 4 is a side elevation of the system in the retracted position.
Figure 5:
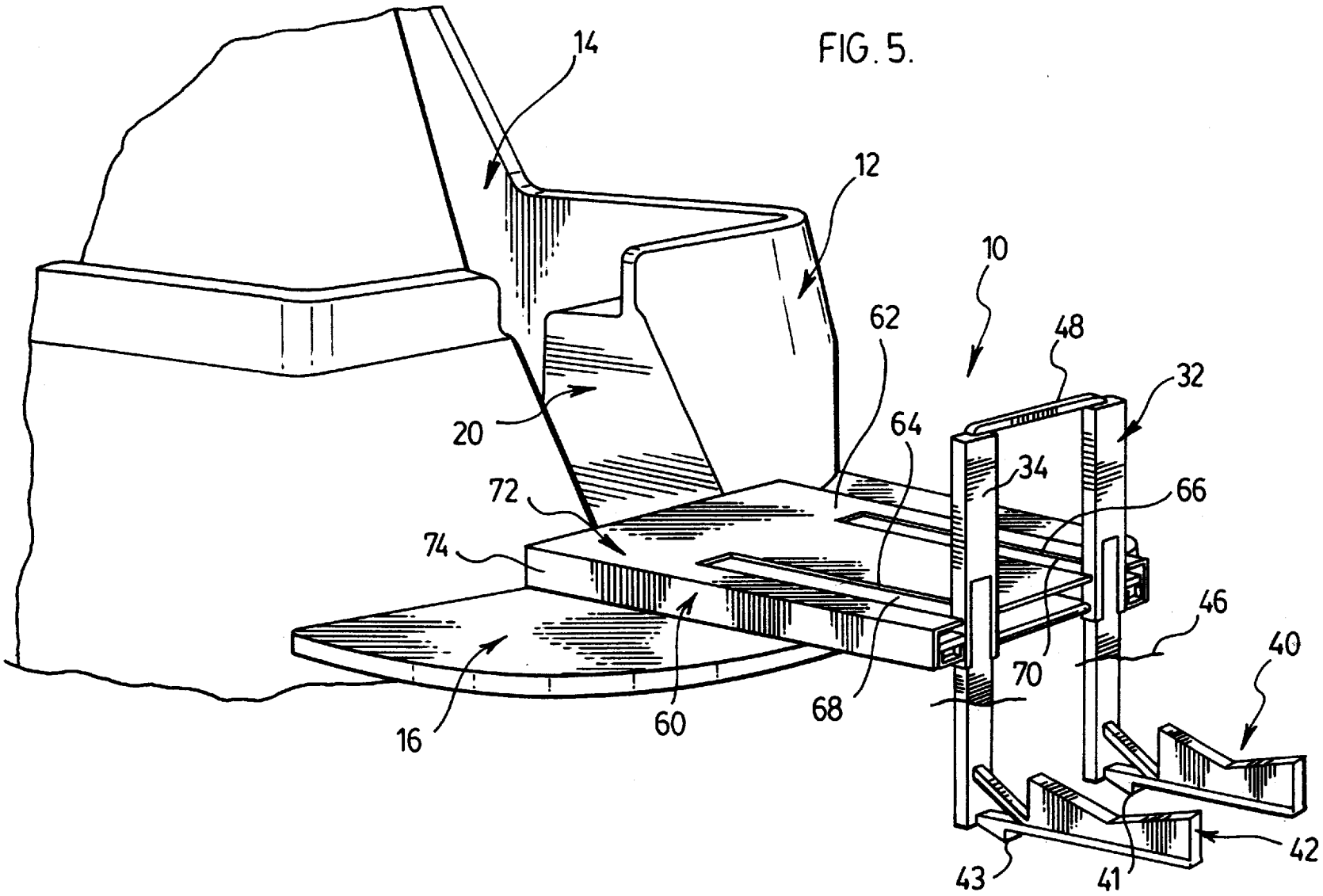
FIG. 5 is a perspective view of the system of FIG. 1 with protective housing in place.

With reference to FIG. 5, the system 10 is adapted for mounting on a swim platform 16 secured to the aft 12 of the watercraft 14. The system 10 is as described in FIG. 1, except a suitable protective housing 60 is provided on top of the assembly for the system 10. The housing 60 covers the second horizontal drives 36 and 38 of FIG. 1. In order to accommodate movement of the first vertical drives 32 and 34 from their extended upper storage position to their retracted upper storage position, as shown in FIGS. 3 and 4, the housing 60 has in its top surface 62, slots 64 and 66 which permit retraction of the vertical drives 32 and 34. The slots 64 and 66 include retractable covers 68 and 70. The covers may slide along channels underneath the top surface 62 of the swim platform 16 into the region generally designated 72 of the housing 60. To provide support for the top surface 62 as well as to prevent feet or hands from venturing under the top surface 62, the housing 60 includes upright sidewalls 74. In this manner, people walking about the swim platform 16 and on top of the unit 10 are discouraged or prevented from catching their feet or hands during the operation of the system 10, or stepping into the internals of the system 10 when not in operation. Hence an important safety feature of the invention is realized by virtue of the low profile of the second horizontal drives 36 and 38 which may be readily covered by a low profile housing 60. The height of the sidewalls 74 need only be sufficient to cover the height of the horizontal drives 36 and 38 which may be in the range of 6 to 12 inches. This permits people to readily step from one side of the swim platform 16 to the other without catching their feet on the internal drives of the system 10. The protective covers 68 and 70 also ensure that people cannot step within the slotted regions 64 and 66. They are preferably spring loaded to follow the vertical drives 32 and 34 as they are extended and retracted. Alternatively, the protective slides 68 and 70 can be simply connected to the vertical drives 32 and 34 and are either pushed into the housing 60 or drawn outwardly of the housing 60 during movement of the cradle. Skids 41 and 43 are also provided to help in reducing the stress and torsion placed on the system 10 by the watercraft 22. When the system is in the retracted position of FIG. 4, the bottom of the skids 41 and 43 rest on the swim platform 16 to relieve the weight from the horizontal drives. This reduces any bouncing or other vertical movement of the system 10 when the system 10 is in the retracted position. It also helps to maintain the durability and useability of the system 10.

Figure 6:
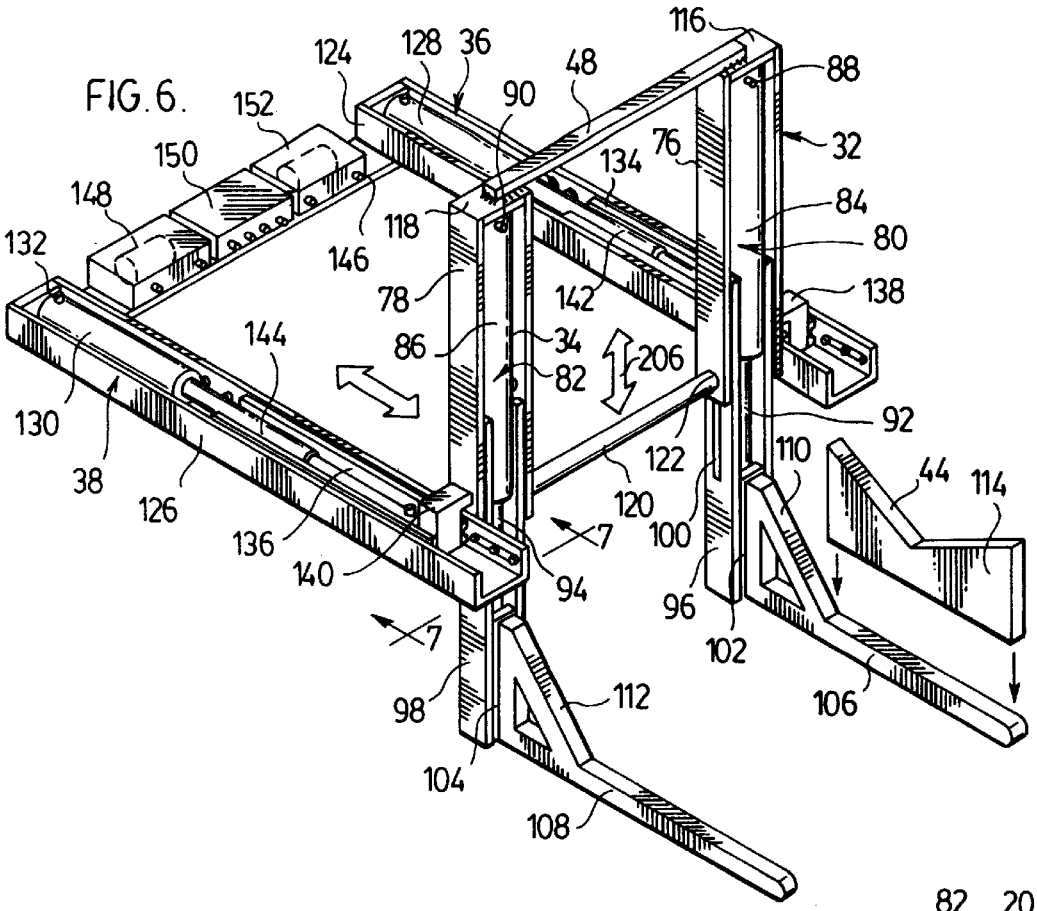
FIG. 6 is a perspective view of the system showing details of the hydraulic cylinders.

Further details of the first vertical drives 32 and 34 and second horizontal drives 36 and 38 are shown in FIG. 6. The first vertical drives 32 and 34 are housed in frames 76 and 78. The drives 32 and 34 include, in accordance with this particular embodiment, hydraulically driven cylinders 80 and 82. The cylinders 80 and 82 are respectively attached by bolts 88 and 90 to their respective housing 76 and 78. Rams 92 and 94 extend downwardly from the cylinders 80 and 82. The housings 76 and 78 is, as will be discussed with respect to FIG. 7, connected to the movable second parts of the second horizontal drives 36 and 38. The second telescopic parts of the first vertically oriented drives comprise telescopic members 96 and 98. The telescopic members 96 and 98 include slides 100, which will be described in more detail with respect to FIG. 7, for guiding the telescopic movement of the members 96 and 98 into and out of the housings 76 and 78. The telescopic members 96 and 98 carry brackets 102 and 104 to which cradle support arms 106 and 108 are mounted. To strengthen the arms 106 and 108, diagonal braces 110 and 112 are also provided. The watercraft support block 114 is secured to the arm 106 and has a shape at 44 to fit that particular portion of the watercraft underside. With reference to FIG. 1, cradle arms 40 and 42 are made up of the arms 106 and 108 and support blocks 114 to be mounted on each arm 106 and 108. The handrail 48, which also acts as a safety grab bar, is secured to the top portions 116 and 118 of the housing 76 and 78. A second bar, which retains the spacing and fixes the distance between the vertical drives 32 and 34, is shown at 120 and is secured as ends 122 to the housings 76 and 78. It is appreciated that the spacing between the cradle arms 40 and 42 may vary depending upon the size of the small craft. In order to increase or decrease spacing, the length of bar 120 is correspondingly varied to fix the desired arm spacing.

With respect to the second horizontal drives 36 and 38, each of them has a housing portion 124 and 126 which houses respective cylinders 128 and 130 secured therein by the bolt 132. Telescopically located in each of the housings 124 and 126 are slides 134 and 136 which carry the brackets 138 and 140. The brackets are secured to the housing 76 and 78 in a manner to be described with respect to FIG. 7. The slides 134 and 136 are telescopically moved within the housing 124 and 126 by respective rams 142 and 144. The various controls for the hydraulics and electronics of the system may be placed between the horizontal drives 36 and 38 on a suitable platform 146. The controls may be housed in three separate waterproof boxes 148, 150 and 152. It is appreciated that, when desired, the control boxes 148, 150 and 152 may be provided inboard of the craft and the necessary hydraulics hoses and wiring be led to the system 10 through a suitable waterproof opening in the hull which is above the water line.

Figure 7:
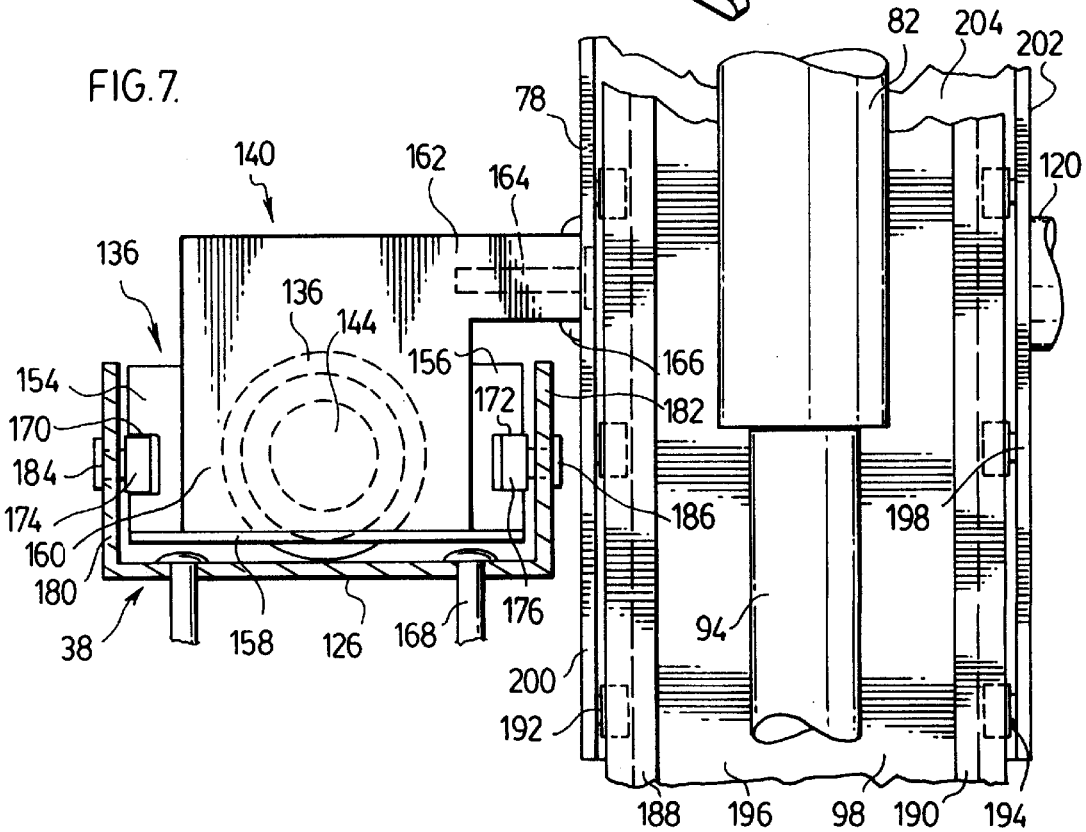
FIG. 7 is a section along the line 7—7 of FIG. 6.

With reference to the section of FIG. 7, further details in the connection of the vertical drives to the horizontal drives is shown. The bracket 140 is secured to the inner telescopic slide 136 which is made up of spaced apart slide members 154 and 156. The slide members 154 and 156 are interconnected by a bottom plate 158 which may be integral with the slides 154 and 156. The bracket 140 has a generally L-shaped configuration with a base portion 158 secured preferably to the opposing slide members 154 and 156. The upper part 162 of the body portion 160 of the bracket 140 is secured to the side of the housing 78 by bolts 164. The body portion 160 of the bracket 140 is of substantial thickness to resist torsion. The connection may also beefed up with a plate and/or the use of fillet welds 166 to again resist the torsion of the twisting of the upright frame relative to the horizontal frame, particularly when the system is in its extended upper position and extended storage position. The first drive 38 also includes the housing member 126 which is secured by bolts 168 to the swim platform or the aft supporting systems. The slides 154 and 156 have U-shaped channels 170 and 172 which slide along respective rails 174 and 176. The rails 174 and 176 are secured to upright portions 180 and 182 by way of bolts 184 and 186. The inner slides ensure that the telescopic member 144 is secured relative to the outer fixed member 126 to resist rocking motion exerted on the bracket 140 by the upright members 32 and 34. Similarly, with respect to the telescopic slide 98 and slide members 188 and 190 which move along slides 192 and 194, the slides are interconnected by a base portion 196 in a manner similar to that in respect of the horizontal drive member 38. The slides 192 and 194 may be bolted to the sides 198 and 200 of vertical housing portion 78. The crossbar 120 may also be secured to the housing 78 either along its edge portion 202 or its rear portion 204.

Figure 8:
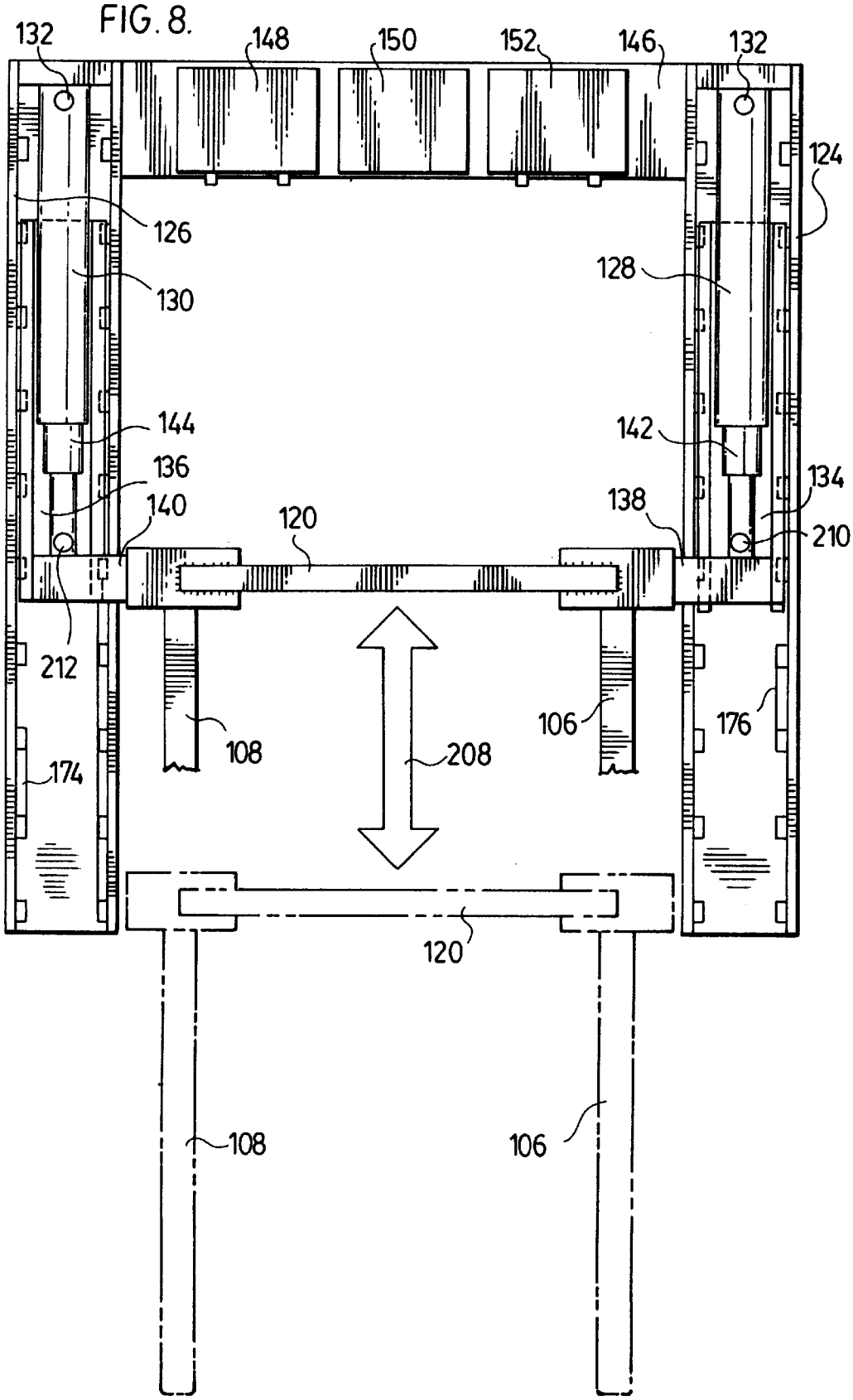
FIG. 8 is a top plan view of the horizontally oriented drive for the system.

As shown in FIG. 6, actuation of the hydraulic cylinders 84 and 86 and is capable of reciprocating the cradle brackets 102 and 104 up and down in the direction of arrow 206. Similarly the horizontal motion for the horizontal drives is shown in FIG. 8 where actuation of the hydraulic cylinders 128 and 130 reciprocates the brackets 138 and 140 in the direction of arrow 208. The slides 134 and 136, as secured to the brackets 138 and 140, move reciprocally and telescopically within the housing members 124 and 126 where such movement is guided by the rails 174 and 176. The length of the rails and the slides are such to withstand torsion transferred to the slide members through the brackets 138 and 140 to ensure that the horizontal drives do not collapse or become bent during use. Also as shown in more detail, the cylinders are secured in place by the bolts 132 and the rams 142 and 144 are bolted to the brackets 138 and 140 by pins or bolts 210 and 212.

Figure 9:
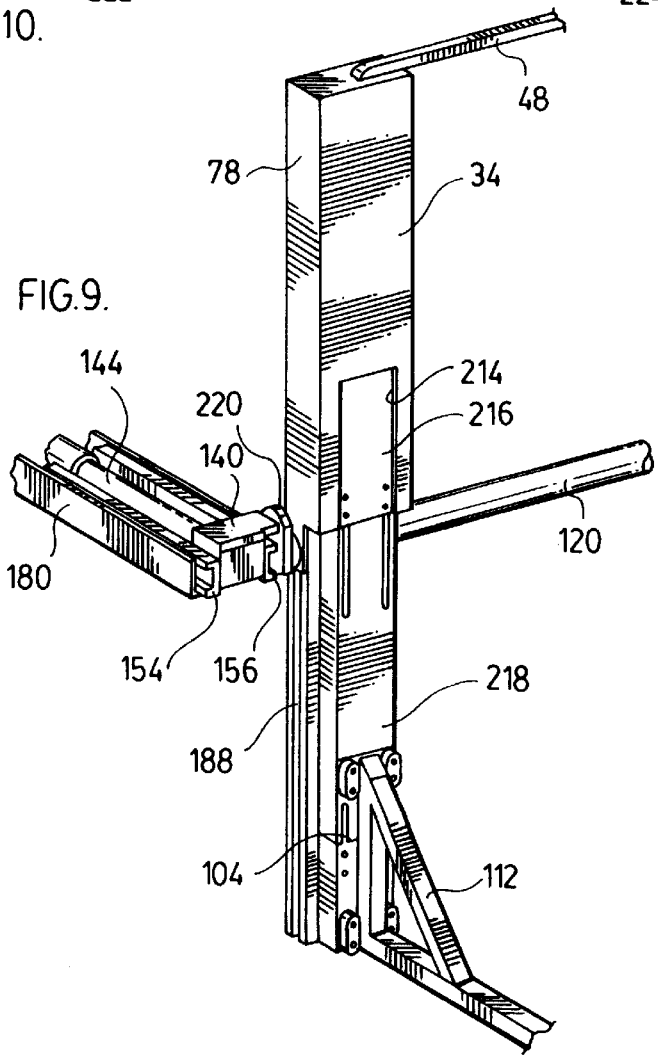
FIG. 9 is a perspective view of the slide for shielding internals of the vertical arms.

With reference to FIG. 9, the sliding covers plates for the vertical drives, and in particular drive 34 is shown. The housing 78 has a slot 214 covered by a first plate 216 under which a second plate 218 slides. This ensures that for any vertical movement for the cradle, one cannot insert their hands or their feet within the housing 78 and possibly be injured. Instead, the user is protected from these moving components to further ensure safety in the use of the device. The lower end of the vertical drive 34 has the bracket 104 with the diagonal support portion 112. Also as shown in FIG. 9, the mounting of the bracket 140 on the housing 78 may include a mounting plate 220 which can be bolted and/or guided to the side of the housing 78. In addition, the slide 188, as secured to the inner telescopic member of vertical drive 34, is shown at length in FIG. 9.

Figure 10:
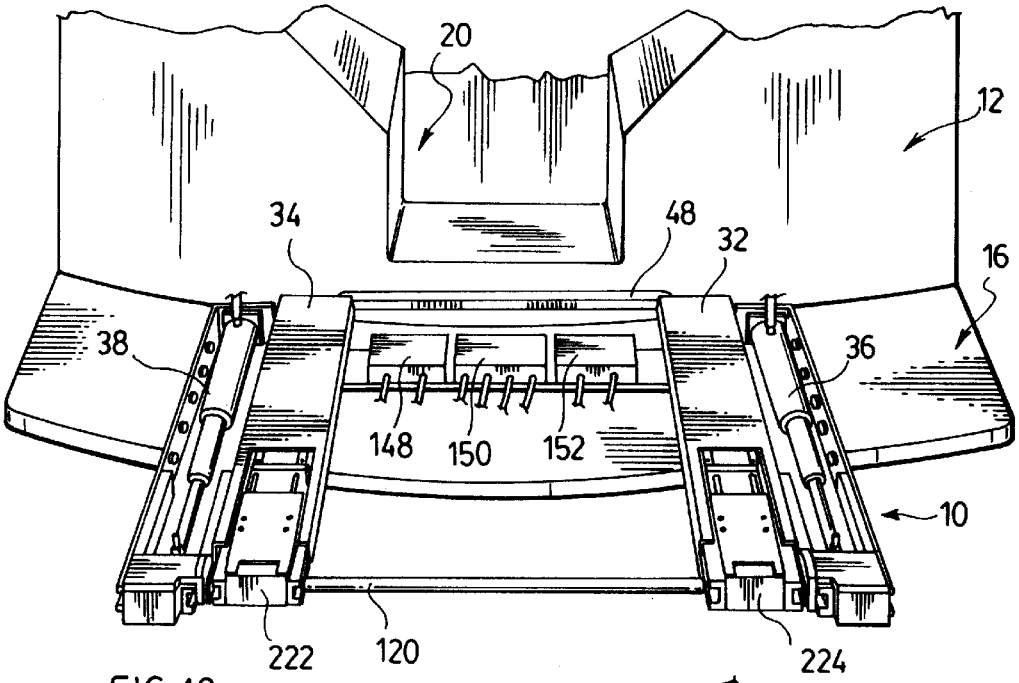
FIG. 10 is a perspective view of an alternative embodiment of the system in the collapsed position.
Figure 11:
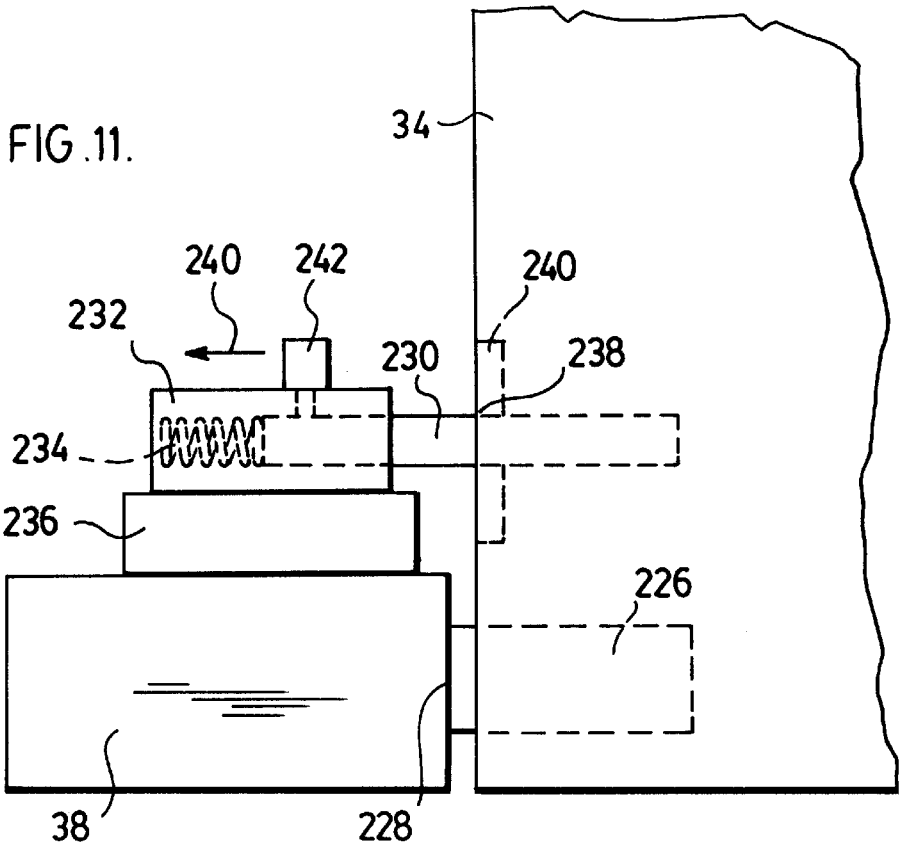
FIG. 11 is an enlarged view of the device which permits collapse of the vertical arms.

With reference to FIG. 10, an alternative embodiment for the system 10 is shown. The vertical drives 32 and 34 are collapsed and fold within the horizontal drives 36 and 38. The collapsed position for the drives 32 and 34 can be accomplished by pivotal mounting of end portions 222 and 224 to the horizontal drives 36 and 38. A representative assembly is shown in FIG. 11 where the vertical drive 34 is pivotally connected to the horizontal drive 38 by a pin 226. Pin 226 is secured to the side 228 of the first drive 38. A retractable pin 230 is provided in cylinder 232 and is preferably spring-loaded at 234. Cylinder 232 is fully retracted and is secured to a plate 236 which, in turn is secured to the housing of the horizontal drive 38. With the vertical drive 34 in the vertical position, the pin 230 is inserted through an aperture 238 and through an internal plate 240 of the vertical drive 34. When it is desired to lay or collapse the vertical drive down on the swim platform, the pin 230 is retracted in the direction of arrow 240 by way of finger detent 242 so as to remove it from the aperture 238 and allow the vertical member to pivot downwardly about the pivot pin 226. Hence the unit assumes the collapsed position as shown in FIG. 10. This may be a desirable feature when the personal watercraft is launched for extended periods of time and it is not desirable to have the vertical members extending upwardly from the swim platform.

Figure 12:
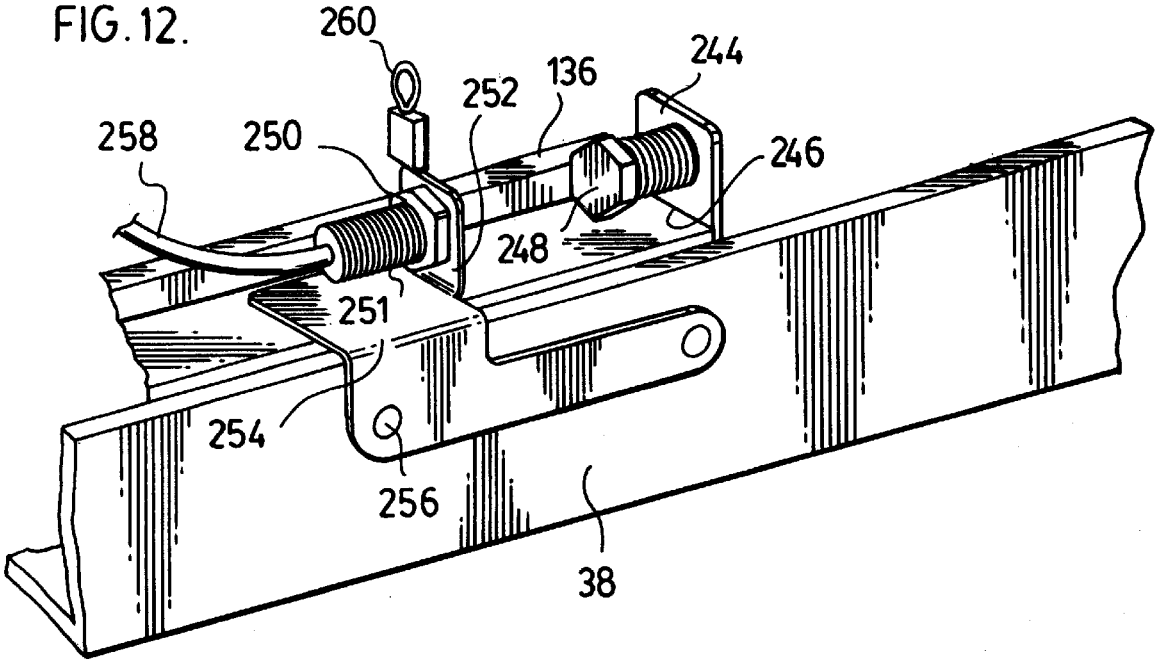
FIG. 12 is a perspective view of a limit detection switch in the normally open position.

As will be described in more detail with respect to foolproof and safe operation of the hydraulic cylinders, limit switches which detect the extended upper position and the extended storage position may be used. The limit switches may be of a variety of limit switches which involve toggles, cams, magnetic fields and the like. The preferred limit switches are of the type shown in FIGS. 12. The limit switches are mounted on the base of the horizontal drive 38, for example. The slide 136 has a plate 244 secured to a free end 246 thereof. A bolt 248 is threaded therein to provide for fine adjustment of head position in setting up the position sensing. The bolt 248 has a head which is a permanent magnet. The read switch 250 is housed in housing 251 which is secured by bracket 252 to plate 254 which is, in turn, riveted at 256 to the base of the horizontal drive unit 38. As the bolt head 248 approaches the read switch 250, the presence of the magnetic field is sensed and a signal is then transmitted via line 258. Optionally, a LED 260 may be provided to indicate when the read switch 250, which is normally open, is normally closed due to the presence of the magnetized bolt head 248. The signal of line 158 is transmitted to the controller system, as will be described with respect to FIGS. 13 and 14 to provide for the foolproof and safe operation of the hydraulics.

Figure 13:
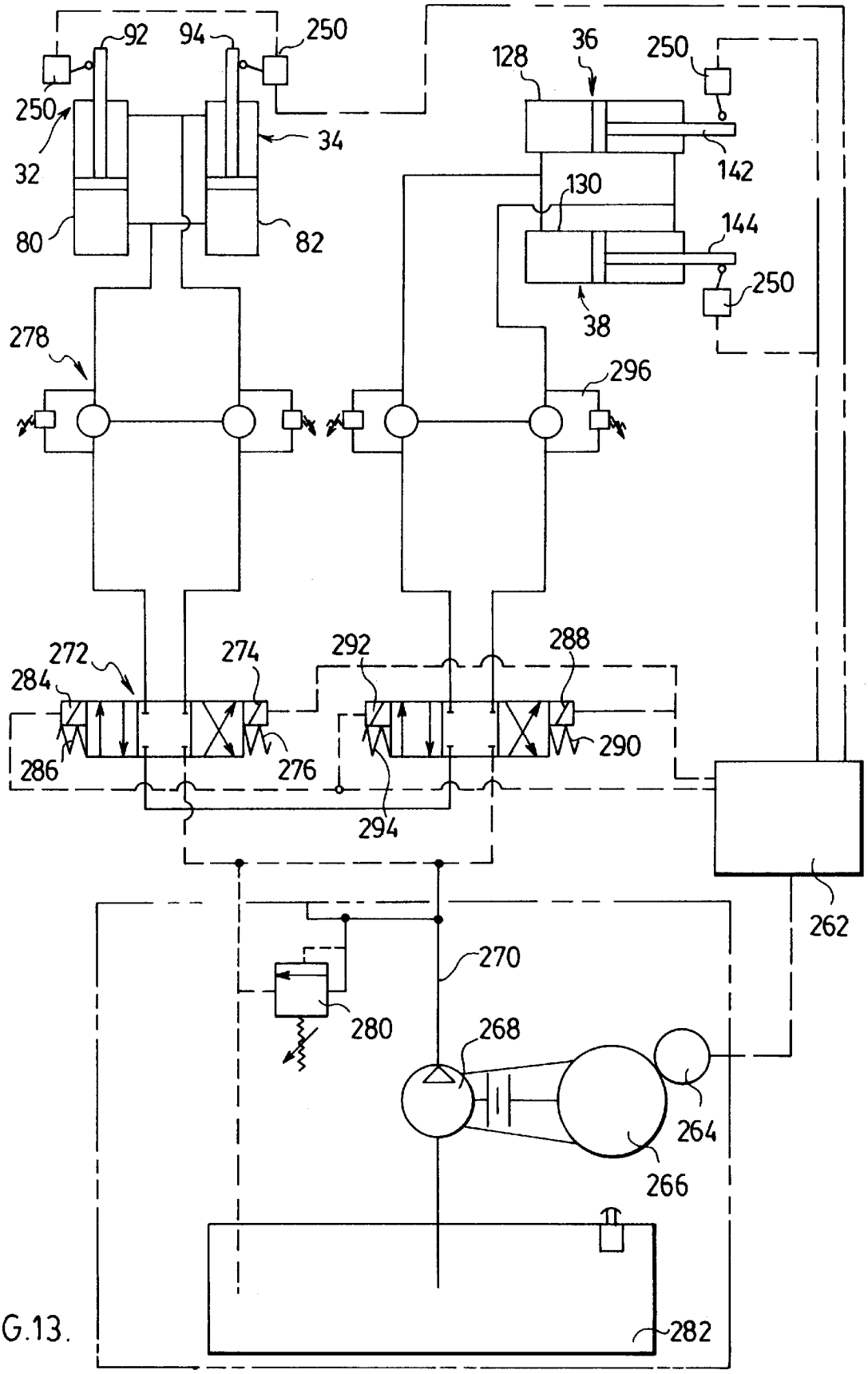
FIG. 13 is a schematic of the hydraulic system.

Turning to FIG. 13, a schematic diagram is provided of the hydraulics used in the system. In the following example, it is assumed that the operator has requested the system to move down from the extended storage position to the lower retrieval position. A signal is sent from a radio junction box 262 to initiate movement of the vertical drives 32 and 34. The signal is received by a starter relay 264 which, in turn, signals a motor 266 to start. The motor 266 pumps hydraulic fluid by a hydraulic pump 268 via line 270 to a directional control valve 272. Since the system is moving down, a down solenoid 274 and a down relay coil 276 shift the directional control valve 272 so that a path is created between the hydraulic pump 268 and the first drive 1. A flow divider 278 is located between the vertical and the directional control valve 272 in order to ensure that both vertical drives 32 and 34 receive equal amounts of fluid. While moving down, it will be noticed that the cradle arms with attached rams 92 and 94 lose contact with the limit switches 250 and the limit switches inform the radio junction box 262 that the system may no longer move in the horizontal direction. To avoid damage to the hydraulic system, a hydraulic fluid relief valve 280 senses the pressure on the line 270 and if a predetermined pressure limit is exceeded on the line 270, the fluid dumps to a reservoir 282. Therefore, if the system has reached the lower retrieval position, the fluid generated by the pump 268, to move in a horizontal direction, is returned to the reservoir 282 to be reused since there is no path for the hydraulic fluid to run and the pressure on the line 270 will exceed the predetermined limit. On the other hand, if the operator continues to move down after the lower retrieval position has been reached, the system will simply allow the path to be created and returns the fluid to the reservoir 282. It will be well known to those skilled in the art that this example holds true for all directions and is not restricted to solely the down direction. For the up direction, up solenoid 284 and up relay coil 286 function in a similar manner as the down solenoid 274 and the down relay coil 276. Likewise, in solenoid 288, in relay coil 290, out solenoid 292 and out relay coil 294 perform analogous functions for inward and outward movement. For inward and outward movement, flow divider 296 functions in a similar manner to flow divider 278.

Figure 14:
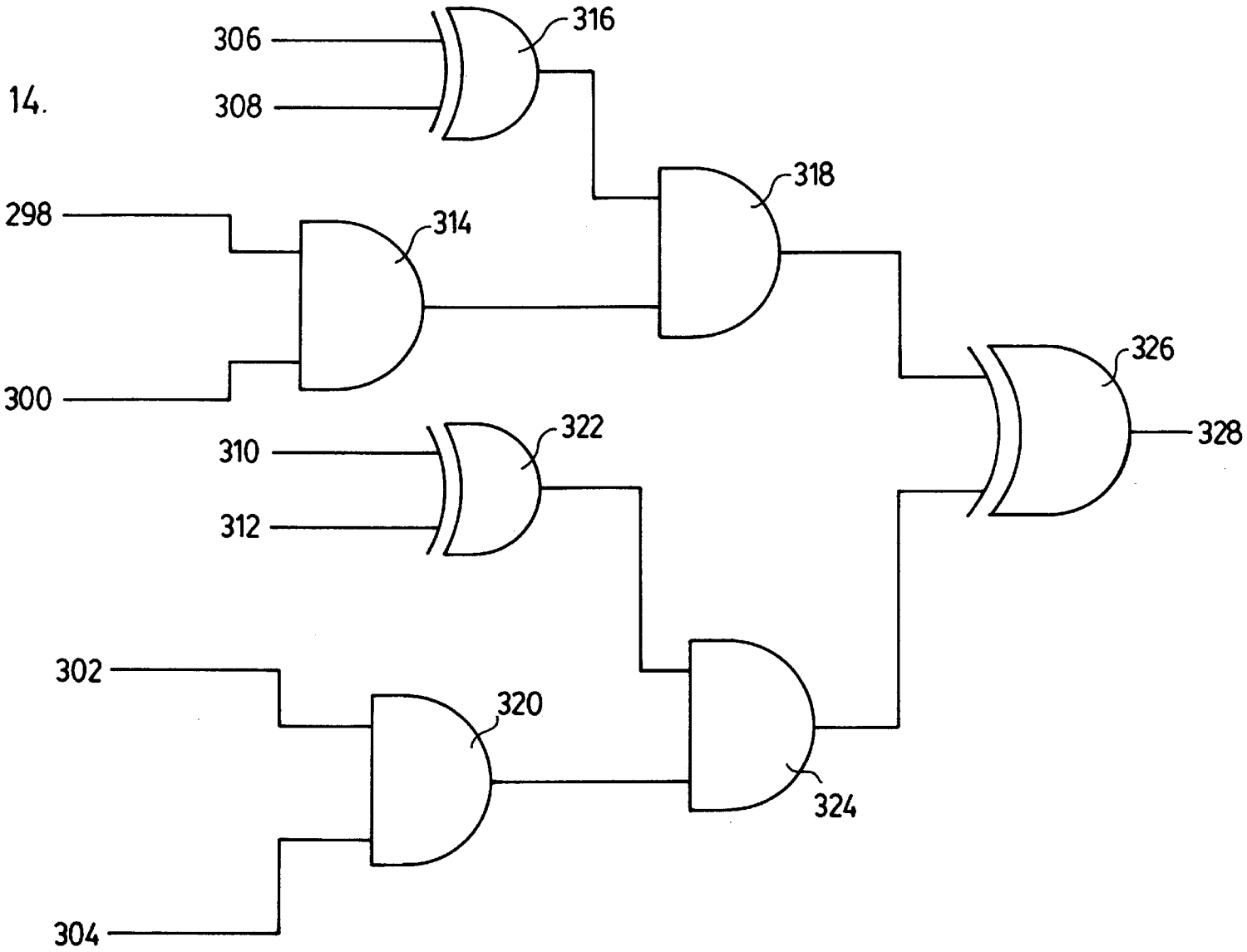
FIG. 14 is a schematic of the programmable logic used in the sensory control.

Turning to FIG. 14, a logic diagram is provided of the safety sensory control of the present invention. As described above with reference to FIG. 12, the limit switches 250 sense when a magnetic filed is present which is analogous to either the elevated retrieval position or fully extended upper position. Unless the limit switches have sensed the elevated retrieval position, the system may not move in a horizontal direction. Likewise, unless the limit switches 250 have sensed the fully extended upper position, the system may not move in a vertical direction. If the elevated retrieval position has not been sensed, the in and out solenoids 288 and 292 are signalled to not move and thus a path between the hydraulic pump 268 and the horizontal drives 36 and 38 is not achieved and no horizontal movement is possible. This works in the same manner for the fully extended upper position.

When the positions are sensed, their inputs are seen as high. The operation of logic circuits and gates will be well known to those skilled in the art. Inputs 298 and 300 represent the signals sent from the pair of limit switches on the horizontal drives while inputs 302 and 304 represent the signals from the pair of limit switches on the vertical drives. Inputs 306 and 308 represent up and down signals sent from the hand held transmitter to the system while inputs 310 and 312 represent in and out signals sent from the hand held transmitter to the system. Looking specifically at inputs 298 and 300, it will be understood by those skilled in the art that both inputs must be high for AND gate 314 to produce a high signal as an output. With respect to inputs 306 and 308, only one of the two inputs may be set high or else the output of XOR gate 316 will not be high. The output of an AND gate and an XOR gate will be well known to those skilled in the art. This restricts movement of the system in only one direction and ensures that the system will not break down if both directions are requested simultaneously. If both outputs from AND gate 314 and XOR gate 316 are high, then output of AND gate 318 will also be high. It will be well known to those skilled in the art that a similar case arises for inputs 302, 304,310 and 312. Logic gates 320,322 and 324 function in an analogous manner to logic gates 314, 316 and 318 respectively. As described above, for XOR gate 326 to produce a high output, only one of its inputs may be high. This ensures that only one direction may be selected at 328. This ensures safe and foolproof operation of the system. The use of signals from the limit switches ensures that the user may not move the system in a vertical direction unless the fully extended storage position is sensed and in a horizontal direction unless the elevated retrieval position is sensed. Improper or unsafe direction movement signals from the hand held transmitter will be ignored and this feature further helps to protect users from injury and make the system foolproof to use. Also, by restricting movement in only one direction, there is also less chance of damage to the system and the larger craft.

Although in accordance with a preferred embodiment of the invention, hydraulic cylinders are used to reciprocate the vertical telescopic members and the horizontal telescopic members. The hydraulics lend themselves to electromechanical control, precision in movement and handle high loads with low profile hydraulic cylinder units. It is understood, however, that alternative systems may be devised to provide for the horizontal and vertical movement of the cradle on its launch position to its storage position and movement of the cradle from its extended position to its retracted position. For example, as shown in FIG. 15, a worm drive 330 is provided. The worm drive unit 330 comprises a helical screw 332, which has its free end mounted in block 334 of the housing 306 for the horizontal drive. The other end 338 of the helical screw 332 is secured to the driveshaft of a motor 340 which may be hydraulically driven or electrically driven through leads 342 and 344. The motor 340 is secured at its face 346 to the housing 336 for the horizontal drive. By actuation of the motor 340 to drive either on a clockwise or counterclock-wise direction as indicated by arrow 348, the screw 332 is rotated in a corresponding direction to move the bracket 350 in the direction of arrow 352. The direction is, of course, determined by the threaded collar 354 as it engages the screw 332 so that with clockwise rotation, for example, the bracket 350 advances along the horizontal drive and in the opposite direction of rotation retracts within the horizontal drive.

An alternative embodiment for the drives is shown in FIG. 16. A cable system generally designated 356 has two sets of cables 358 and 360 secured respectively to brackets 362 and 364. The brackets move along the slides in the manner described with respect to FIG. 7. The cables may be extended and retracted by actuation of hydraulic cylinders 366 which are capable of extending rams 368 and 370 either outwardly or inwardly. If the rams 368 and 370 are extended outwardly in the direction of arrows 372 and 374, the blocks or brackets 362 and 364 are advanced in the direction of arrows 376 and 378. The pulleys 380 and 382 may be secured within the housing for the first drives. Hence upon retraction of the rams 368 and 370 into the cylinder 366, the brackets 362 and 364 are retracted along the first drive. It is understood that in place the hydraulic cylinders 366, a mechanical gear drive may be used to wind in or push out the cable. This is particularly useful when it is desired to have a manual override in the launch and retrieval of the personal watercraft. The manual override can be particularly useful in the event of power failure. It is understood, however, that with the hydraulic system a hydraulic hand pump or the like may also be used to achieve in emergency situations watercraft launch and/or retrieval.

It is understood that the launch and retrieval system of this invention provides for safe operation even in environments where there is considerable wave action. The system is foolproof in operation in that the hydraulic cylinders or other forms of drives can only be actuated if the cradle is in the correct position when there is a command to either elevate or lower the cradle or extend or retract the cradle. By virtue of the low profile of the horizontal drives and their connection to the vertical drives at a location essentially at the level of the swim platform, minimal stresses are placed on the unit in carrying the personal watercraft. The low profile for the system also permits easy safe maneuvering about the platform. In the event of battery failure to drive the hydraulics, one may free the small craft and slide it off the cradle to reach safety. The use of the skids as discussed with respect to FIG. 5 when pulled onto the swim platform or other form of support ensures that excessive moments are not exerted on the system during high speed boat travel. It is appreciated that alternative devices to the skid system may be used to lock in the position of the cradle during high speed boat travel. This may include retractable pins or clamps provided on the swim platform. In view of the fullproof nature of the launch and retrieval system, it is understood that the sensory control system with the remote control unit can be applied to other types of launch and retrieval systems to ensure that the unit is not moved in a direction which can cause personal damage, damage to the unit or damage to the craft that the launch and retrieval system is carrying. In view of the programmable nature of the system, it is understood that a variety of different elevations and retracted positions may be achieved depending upon the position of the sensory devices. It is also understood that the LED's that are provided in conjunction with the limit switches when lit can be relied on by the user or the repair person to troubleshoot the operation of the system in the event of an apparent failure. It is also understood that the transmitter does not have to be hand held but may be connected directly to the hydraulic control. It is also understood that rollers may be used instead of slides for movement of the telescopic members within the first members or both the vertical and horizontal drives.

Although preferred embodiments of the invention have been described herein in detail, it will be understood by those skilled in the art that variations may be made thereto without departing from the spirit of the invention or the scope of the appended claims.

I claim:

1. A launch and retrieval system for a watercraft, said system being adapted for mounting at the aft of a large watercraft, said system comprising:

i) a cradle for a watercraft;

ii) a first vertically oriented drive;

iii) means for securing said cradle to said first drive for vertical movement from a watercraft launch or retrieval lower position to an upper storage position;

iv) a second horizontally oriented drive and aft mounting means for aft mounting said second drive at about swim platform level of a larger watercraft, said second drive having a low profile telescoping frame having a first part fixed to said aft mounting means and a telescopic second part, said second drive having power means to reciprocate said second part relative to said first part, said telescopic second part having an outboard end;

v) means for mounting said first drive to said outboard end of said telescopic second part of said second drive to position thereby the mounting of said first drive to said second drive at about swim platform level, said second drive moving said vertically oriented first drive from an extended cradle storage position to retracted cradle storage position; and vi) said first drive elevating said cradle to a level for its storage position which permits said power means to retract at least a portion of said cradle to within said second drive.

2. A launch and retrieval system of claim 1 wherein said first and second parts of said second drive comprises spaced apart telescopic caged slides, each said slide having first and second slide members, said aft mounting means extending generally horizontally said slides outwardly of a watercraft and securing said first slide members in parallel spaced apart relationships, said second slide members having said outboard ends, said first drive having a width to fit within spacing between said slides.

3. A launch and retrieval system of claim 2, wherein said first drive comprises spaced apart generally vertical caged slides having first and second slide members, said means mounting said first slide members of said first drive to said outboard ends of second slide members of said second drive.

4. A launch and retrieval system of claim 3 wherein said mounting means for said first drive comprises a bracket secured to each of said first slides of said first drive and secured to each of said second slides of said second drive, said bracket resisting torsion about said bracket.

5. A launch and retrieval system of claim 4 wherein said first slides of said first drives are adapted to be secured in said spaced apart manner to a swim platform of a larger craft.

6. A launch and retrieval system of claim 3 wherein said cradle securing means secures said cradle to said second slide members of said second drive, said cradle having cradle arms which are spaced apart in a manner to fit between said second drives slides.

7. A launch and retrieval system of claim 6 wherein said first slides of said first drives are adapted to be secured in said spaced apart manner to a swim platform of a larger craft, said cradle arms having load bearing supports on their undersides, said load bearing supports engaging a swim platform as said second drive retracts said first drive to position said at least a portion of said cradle to within said second drive, said load bearing supports reducing torsion on said means for mounting said first drive to said second drive.

8. A launch and retrieval system of claim 7 wherein said means for mounting said first drive to said second drive is a pair of brackets, each bracket securing a first slide member of said first drive to a second slide member of said second drive.

9. A launch and retrieval system of claim 3 wherein said first slide members of each said caged slide comprises a U-shaped channel having a base and upstanding legs, opposing bearing means being provided on said legs, said second slide member having bearing engaging means to capture thereby said second slide and provide said caged slides.

10. A launch and retrieval system of claim 9 wherein said first and second drives comprise hydraulic cylinders for moving said slide members.

11. A launch and retrieval system of claim 10 wherein said caged slides have telescoping protective shields to shield users from moving hydraulic cylinders.

12. A launch and retrieval system of claim 10 wherein an hydraulic pump with electrically controlled valves supply pressurized hydraulic fluid to said cylinders to effect movement of said slide members in the desired direction, an electronic controller being provided for said electrically controlled valves and limit switches being provided to signal to said controller first drive launching and cradle storage positions and second drive extended cradle storage position and retracted cradle storage position.

13. A launch and retrieval system of claim 12 wherein said limit switches include LED's for easy inspection of operability of said launch and retrieval system.

14. A launch and retrieval system of claim 12, said electronic controller being programmable to permit movement of said first drive only when said second drive is in extended cradle storage position and to permit movement of said second drive only when said first drive is in cradle storage position.

15. A launch and retrieval system of claim 14 wherein a remote control transmitter is provided to operate said electronic controller having a corresponding remote control signal receiver.

16. A launch and retrieval system of claim 9 wherein said first and second drives comprises worm drives for moving said slide members.

17. A launch and retrieval system of claim 9 wherein said first and second drives comprise a cable system for moving said slide members.

18. A launch and retrieval system of claim 1 wherein said system further comprises a protective housing covering said second horizontally oriented drive for protecting users from moving first and second parts of said second drive.

19. A launch and retrieval system of claim 18, wherein said housing is in the form of a rigid platform for supporting a user.

20. A launch and retrieval system of claim 19 wherein said rigid platform further comprises a pair of slots for housing said first drive when said second drive moves said first drive to said retracted cradle storage position from said extended cradle storage position.

21. A launch and retrieval system of claim 20 wherein said pair of slots further comprises a sliding cover, connected to said first drive and for protecting users from moving said first and second parts when said first drive is in said extended cradle storage position or said retrieval lower position.

* * * * *